US007371075B2

(12) United States Patent
Liao et al.

(10) Patent No.: US 7,371,075 B2
(45) Date of Patent: May 13, 2008

(54) ELECTRICAL CONNECTOR WITH DUAL-FUNCTION HOUSING PROTRUSIONS

(75) Inventors: Fang-Jwu Liao, Tu-Chen (TW); Ming-Lun Szu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 237 days.

(21) Appl. No.: 10/894,735

(22) Filed: Jul. 19, 2004

(65) Prior Publication Data

US 2005/0014398 A1 Jan. 20, 2005

(30) Foreign Application Priority Data

Jul. 18, 2003 (TW) ..... 92213181 U

(51) Int. Cl.
*H01R 12/00* (2006.01)

(52) U.S. Cl. ..... 439/71

(58) Field of Classification Search ..... 439/68–71, 439/266, 330, 342, 525, 885, 526, 527, 263, 439/64, 259, 331, 264–265
See application file for complete search history.

(56) References Cited

U.S. PATENT DOCUMENTS 3,951,495 A * 4/1976 Donaher et al. ..... 439/330
4,616,895 A * 10/1986 Yoshizaki et al. ..... 439/330
5,967,797 A 10/1999 Maldonado
6,132,220 A 10/2000 McHugh et al.
6,146,151 A 11/2000 Li
6,176,707 B1 1/2001 Neidich et al.
6,196,852 B1 3/2001 Neumann et al.
6,447,318 B1 * 9/2002 Okamoto ..... 439/266
6,604,950 B2 8/2003 Maldonado et al.
6,695,625 B1 * 2/2004 Ma et al. ..... 439/70
6,705,876 B2 3/2004 Eldridge
6,824,395 B2 * 11/2004 Uratsuji ..... 439/70
2004/0203264 A1 10/2004 Liao et al.

* cited by examiner

*Primary Examiner*—Edwin A. Leon
(74) *Attorney, Agent, or Firm*—Wei Te Chung

(57) ABSTRACT

An electrical connector (1) for connecting a land grid array (LGA) chip with a printed circuit board (PCB) includes a housing (10), and terminals (11) received in passageways (104) of the housing. The housing defines a base (100) and sidewalls (12, 14), the base and the sidewalls cooperatively defining a space therebetween for receiving the LGA chip. The base has a multiplicity of walls respectively between every two adjacent passageways along a length thereof, and four peripheral raised portions (102) extending upwardly and adjoining the sidewalls respectively. A multiplicity of protrusions (106) extends upwardly from the walls respectively. A height of the raised portions is the same as that of the protrusions. When a force is exerted down on the LGA chip to make the LGA chip engege with the terminals, a proportion of the force is borne by the protrusions and the raised portions.

5 Claims, 6 Drawing Sheets

ELECTRICAL CONNECTOR WITH DUAL-FUNCTION HOUSING PROTRUSIONS

CROSS REFERENCE TO RELATED APPLICATION

This application is a continuation-in-Part application with regard to the copending application Ser. No. 10/822,099 filed Apr. 9, 2004 having the same applicants and the same assignee with the instant application, and also relates to a co-pending U.S. patent application Ser. No. 10/318,593 filed on Dec. 13, 2002, entitled "ELECTRICAL CONNECTOR WITH DUAL-FUNCTION SIDEWALLS," invented by Han-Yuan Ma, and assigned to the same assignee as the present invention.

BACKGROUND OF THE INVENTION

1. Field of the Invention

The present invention relates to an electrical connector for electrically connecting an electronic package such as a land grid array (LGA) chip with a circuit substrate such as a printed circuit board (PCB), and particularly to a connector having protrusions that minimize the risk of accidental damage to an associated electronic package.

2. Description of the Prior Art

Land grid array (LGA) electrical connectors are widely used in the connector industry for electrically connecting LGA chips to printed circuit boards (PCBs) in personal computers (PCs). As described in "Nonlinear Analysis Helps Design LGA Connectors" (Connector Specifier, February 2001, pp. 18-20), the LGA connector mainly comprises an insulative housing and a multiplicity of terminals. The housing comprises a multiplicity of terminal passageways defined therein in a generally rectangular array, for interferentially receiving corresponding conductive terminals. Due to the very high density of the terminal array in a typical LGA chip, the LGA chip need to be precisely seated on the LGA connector to ensure reliable signal transmission between the terminals and the LGA chip. Means for accurately attaching the LGA chip to the LGA connector are disclosed in U.S. Pat. Nos. 5,967,797, 6,132,220, 6,146,151 and 6,176,707.

Referring to FIG. 8, a conventional connector 6 comprises an insulative housing 60 and a multiplicity of conductive terminals 61 received therein. In forming the connector 6, a plurality of carrier strips (not shown) is used. Each carrier strip comprises a row of the terminals 61, and a row of connecting sections 610 respectively connecting the terminals 61 with a main body of the carrier strip. The housing 60 comprises four raised sidewalls 62, and a flat base 63 disposed between the four raised sidewalls 62. Four raised portions 630 are formed upwardly around the flat base 63. Two opposite of the sidewalls 62 each have a sloped surface that slants down toward a corresponding raised portion 630. The base 63 and the sidewalls 62 cooperatively define a space therebetween for receiving an LGA chip (not shown) therein. The base 63 defines a multiplicity of terminal passageways 64 for receiving the terminals 61 therein. When the LGA chip is seated on the LGA connector 6, the four raised portions 630 and the four sidewalls 62 can securely engage the LGA chip therebetween. When a carrier strip is used to insert a row of terminals 61 into a row of the passageways 64 that is adjacent either of said opposite sidewalls 62, the sloped surfaces provide additional space to manipulate the carrier strip so that the connecting sections 610 can be easily cut off from their corresponding terminals 61.

However, the sloped surfaces diminish the main function of said opposite sidewalls 62, which is to provide sufficiently large surface areas that ensure the LGA chip is securely retained between the sidewalls 62. If the LGA chip is not securely retained, this can reduce the reliability of signal transmission between the terminals 61 and the LGA chip.

In addition, when a force is exerted down on the LGA chip to make pads (not shown) of the LGA chip engage with the terminals 61, the force is borne by the four raised portions 630 around the base 63. A middle portion of the LGA chip is liable to be deformed downwardly. This can adversely affect the reliability of signal transmission between the terminals 61 and the LGA chip, and may even permanently damage the LGA chip. In addition, when said force is exerted, the pads of the LGA chip push contacting portions of the terminals 61 to deform downwardly. The contacting portions may also be laterally displaced during such movement. When this happens, the contacting portions may not be accurately engaged with the corresponding pads, resulting in faulty electronic connection between the terminals 61 and the pads.

Therefore, a new LGA electrical connector which overcomes the above-mentioned problems is desired.

SUMMARY OF THE INVENTION

An object of the present invention is to provide an electrical connector for electrically connecting an electronic package such as an LGA chip with a circuit substrate such as a PCB, whereby the electrical connector is configured to minimize the risk of accidental damage to an associated electronic package.

Another object of the present invention is to provide an electrical connector configured so that terminals of the connector can accurately engage with the associated electronic package.

To achieve the above objects, an electrical connector in accordance with a preferred embodiment of the present invention is for connecting a land grid array (LGA) chip with a printed circuit board (PCB). The connector includes an insulative housing, and a multiplicity of conductive terminals received in the housing. The housing has four sidewalls and a flat base disposed between the sidewalls, the base and the sidewalls cooperatively defining a space therebetween for receiving the LGA chip therein. The base defines a multiplicity of walls respectively between every two adjacent passageways along a length thereof. The base also defines four peripheral raised portions extending upwardly and adjoining the sidewalls of the housing respectively. A multiplicity of protrusions extends upwardly from the walls respectively. A height of the raised portions is the same as that of the protrusions. Two opposite of the sidewalls each define a multiplicity of evenly spaced recesses therein, thereby forming a multiplicity of evenly spaced projections.

When terminals are installed near the projections, a common carrier strip connecting the terminals is bent down so that connecting sections of the carrier strip are received in corresponding recesses. Junction portions between the terminals and their respective connecting sections are cut, and a main body of the carrier strip having the connecting sections is removed. The recesses enable the carrier strip to be manipulated so that sufficient space is made available for cutting off of the connecting sections without interfering with the sidewall thereat. The projections provide precise fitting positioning of the LGA chip in the space. In addition, when a force is exerted down on the LGA chip to make the LGA chip engege with the terminals, the force is borne by and distributed among the raised portions and the protrusions of the walls. This protects the LGA chip from distortion or damage should the force be unduly great. This helps ensure that engagement between the connector and the LGA chip is accurate and reliable. Furthermore, when the force is exerted on the LGA chip to make pads of the LGA chip engage with the terminals, the protrusions can prevent the terminals from being laterally displaced so that the terminals accurately connect with the pads of the LGA chip. This ensures that engagement between the connector and the LGA chip is reliable.

Other objects, advantages and novel features of the invention will become more apparent from the following detailed description when taken in conjunction with the accompanying drawings, in which:

DESCRIPTION OF THE PREFERRED EMBODIMENT

Reference will now be made to the drawings to describe the present invention in detail.

Figure 1:
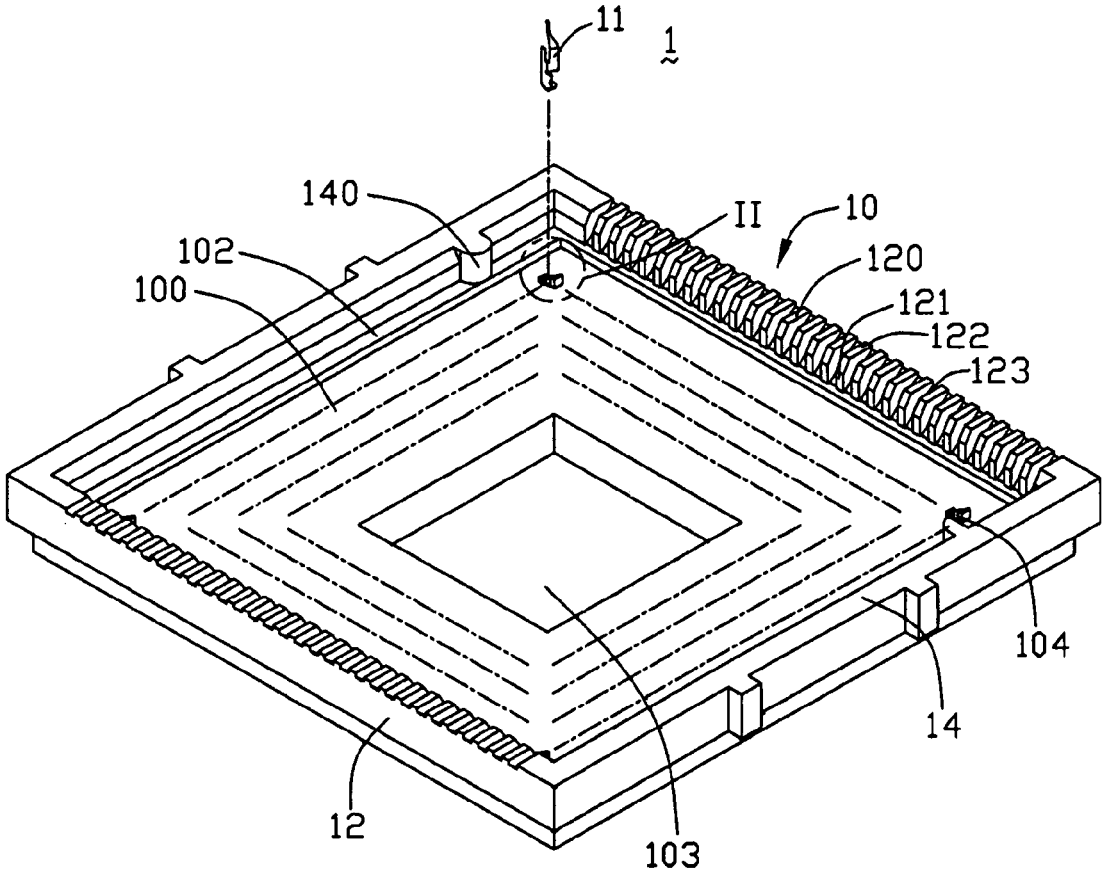
FIG. 1 is a simplified, exploded, isometric view of an LGA electrical connector in accordance with the preferred embodiment of the present invention, showing only one conductive terminal thereof.
Figure 2:
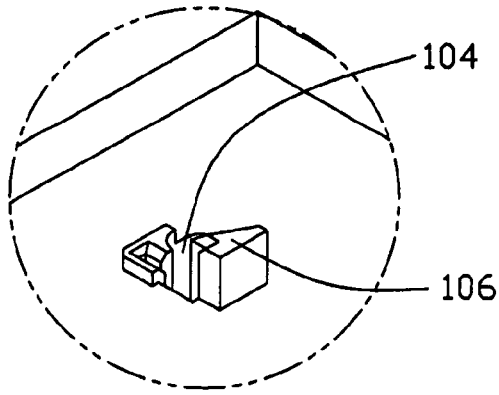
FIG. 2 is an enlarged view of a circled portion II of FIG. 1.
Figure 3:
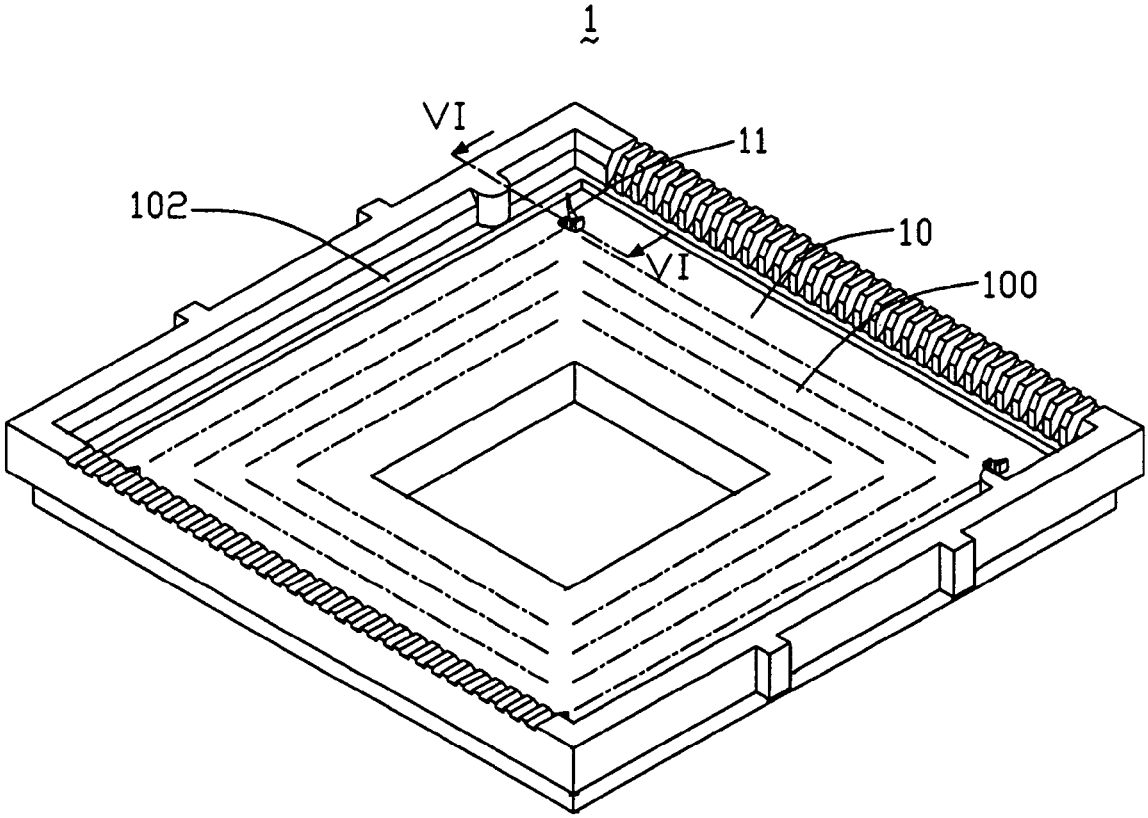
FIG. 3 is an assembled view of FIG. 1.
Figure 4:
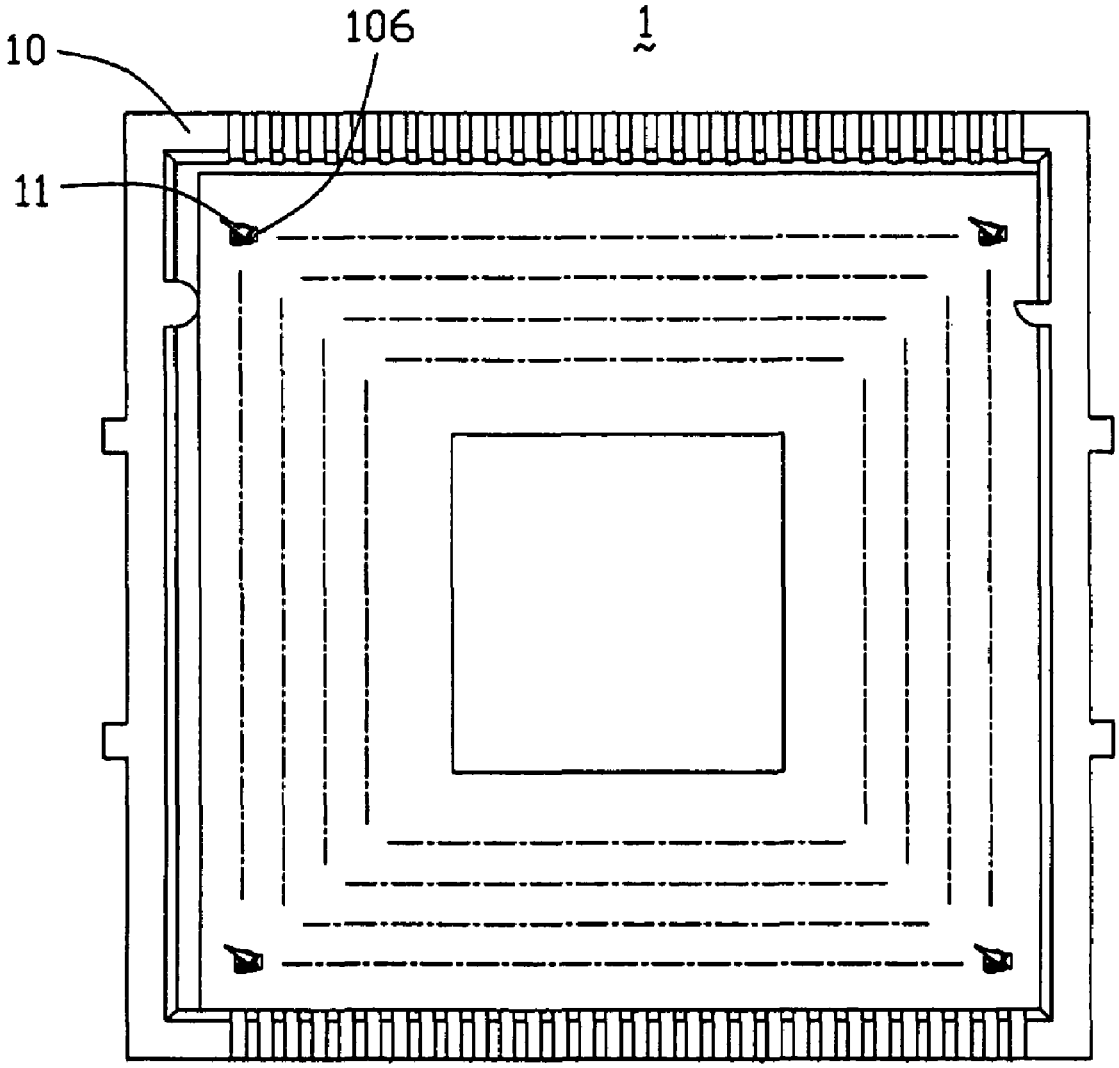
FIG. 4 is a top plan view of FIG. 3.
Figure 6:
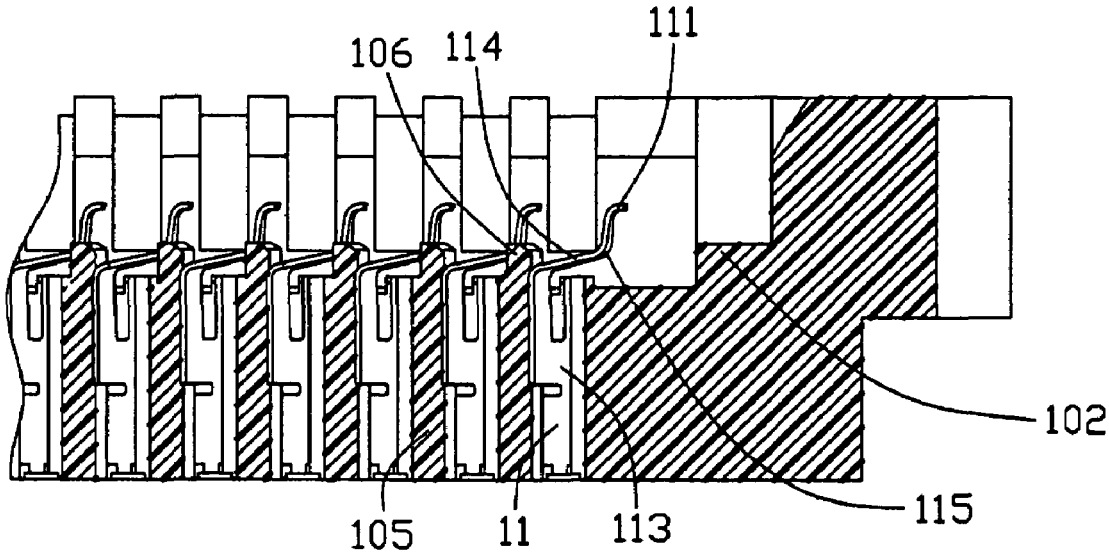
FIG. 6 is a cross-sectional view taken along line VI-VI of FIG. 3.
Figure 7:
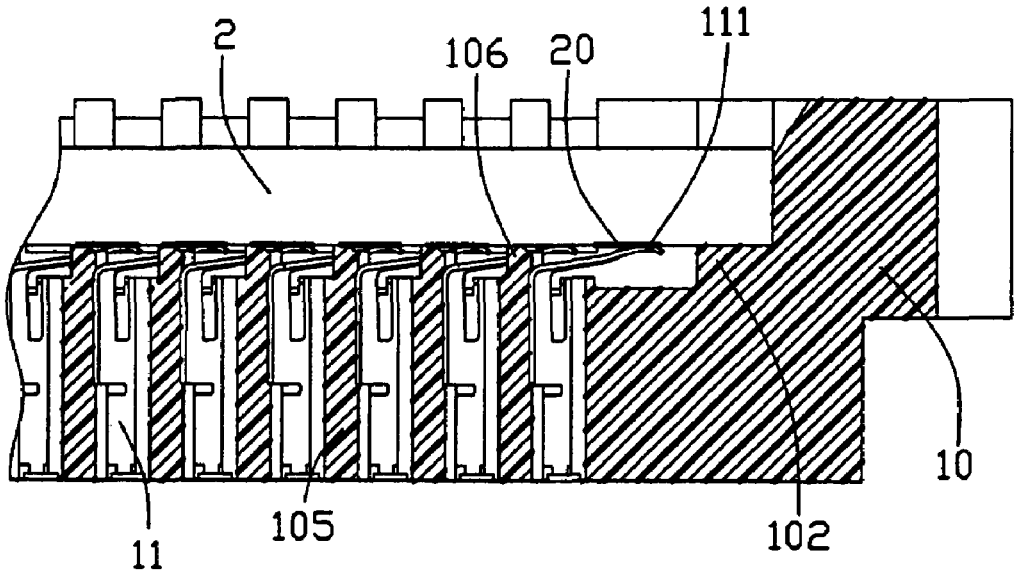
FIG. 7 is similar to FIG. 6, but schematically showing a portion of an LGA chip mounted onto the connector.
Figure 8:
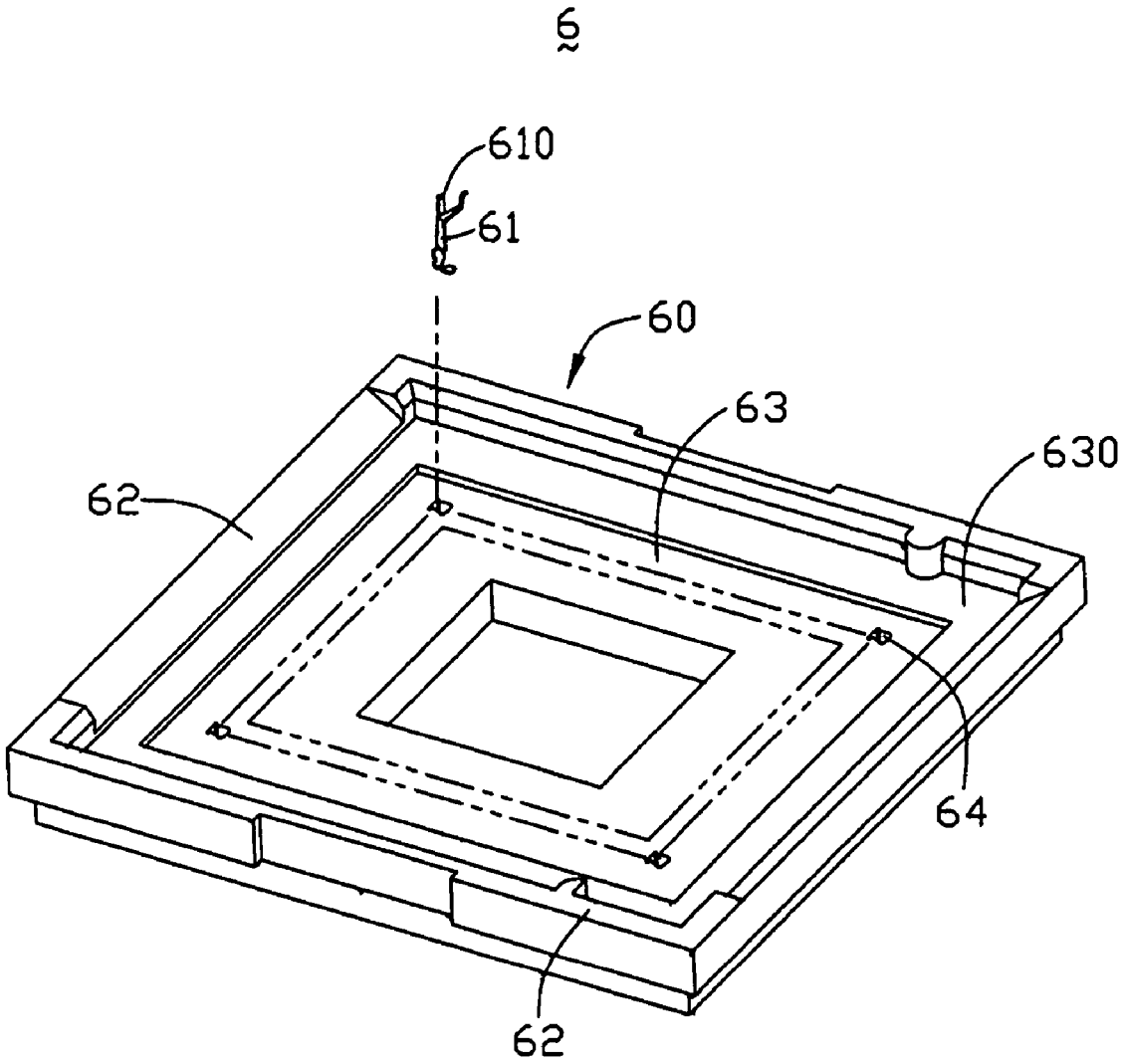
FIG. 8 (PRIOR ART)
FIG. 8 is a simplified, exploded, isometric view of a conventional LGA electrical connector.

Referring to FIGS. 1 and 2, an LGA electrical connector 1 in accordance with the preferred embodiment of the present invention is used for electrically connecting an electronic package such as a land grid array (LGA) central processing unit (CPU) 2 with a circuit substrate such as a printed circuit board (PCB) (not shown). The LGA CPU 2 is hereinafter referred to as the LGA chip 2. The connector 1 comprises an insulative housing 10, and a multiplicity of conductive terminals 11 received in the housing 10. A carrier strip (not shown) comprises a row of the terminals 11, and a row of connecting sections respectively connecting the terminals 11 with a main body of the carrier strip. Referring also to FIGS. 6 and 7, each terminal 11 comprises a retaining portion 113 received in the housing 10, and a spring arm 114 extending slantingly upwardly from a top end of the retaining portion 113. An arcuate contacting portion 111 is defined at a distal end of the spring arm 114, for resiliently electrically contacting a corresponding conductive pad 20 of the LGA chip 2. An elbow 115 is formed in a middle portion of the spring arm 114.

The housing 10 is substantially rectangular, and is formed by molding. The housing 10 comprises two opposite first sidewalls 12, two opposite second sidewalls 14 interconnecting the first sidewalls 12, and a flat base 100 disposed between the first and second sidewalls 12, 14. The base 100 and first and second sidewalls 12, 14 cooperatively define a space therebetween for receiving the LGA chip 2 therein. The base 100 defines a square central cavity 103 therein, and a multiplicity of terminal passageways 104 regularly arranged in a generally rectangular array around the cavity 103. The passageways 104 are for interferentially receiving corresponding terminals 11 therein. The base 100 defines a multiplicity of walls 105 (see FIG. 6) respectively between every two adjacent passageways 104 along a length thereof. The base 100 also defines four peripheral raised portions 102 extending upwardly and adjoining the first and second sidewalls 12, 14 of the housing 10 respectively. A multiplicity of protrusions 106 extends upwardly from the walls 105 respectively. A cross section of each protrusion 106 is trapezoidal. However, in alternative embodiments, each protrusion 106 may have any other suitable shape. A height of the raised portions 102 is the same as that of the protrusions 106. Top surfaces of the protrusions 106 are higher than the elbows 115 of the spring arms 114 of the terminals 11. When a force is exerted down on the LGA chip 2 to make the pads 20 of the LGA chip 2 engage with the terminals 11, a proportion of the force is borne by the protrusions 106 and the raised portions 102.

Each first sidewall 12 is chamfered at a top inner portion thereof. Each first sidewall 12 defines a multiplicity of evenly spaced recesses 123 therein, thereby forming a multiplicity of evenly spaced projections 120. Each recess 123 is bounded at a bottom thereof by a sloped surface of the first sidewall 12, such that an inner portion of the recess 123 is disposed lower than an outer portion thereof. Accordingly, a cross section of each projection 120 is trapezium-shaped. The projection 120 comprises an inmost vertical first surface 121, a top second surface 122, and a chamfered surface between the first surface 121 and the second surface 122. Two blocks 140 are respectively formed on opposite inner faces of the second sidewalls 14. The LGA chip 2 can be guidably fixed between the blocks 140 and the first surfaces 121 of the first sidewalls 12.

Referring to FIGS. 3-6, in assembly of the LGA connector 1, a plurality of the carrier strips is provided. A first carrier strip is positioned above the base 100 of the housing 10, parallel and close to the first surfaces 121 of the projections 120 of one first sidewall 12. The carrier strip is moved downwardly, so that the terminals 11 thereof are received into corresponding terminal passageways 104 of the housing 10. The connecting sections of the carrier strip are located above the passageways 104, parallel to the first surfaces 121 of the projections 120 and opposite corresponding recesses 123 of the first sidewall 12. The carrier strip is bent down toward the first sidewall 12, so that the connecting sections of the carrier strip are received in the corresponding recesses 123. Junction portions between the terminals 11 and their respective connecting sections are cut, and the main body of the carrier strip having the connecting sections is removed. The above procedure is repeated as necessary for one or more other carrier strips at either or both of the first sidewalls 12. Thus, assembly of the LGA connector 1 is completed. The recesses 123 enable each carrier strip to be manipulated so that sufficient space is made available for cutting off of the connecting sections without interfering with the corresponding first sidewall 12.

Figure 5:
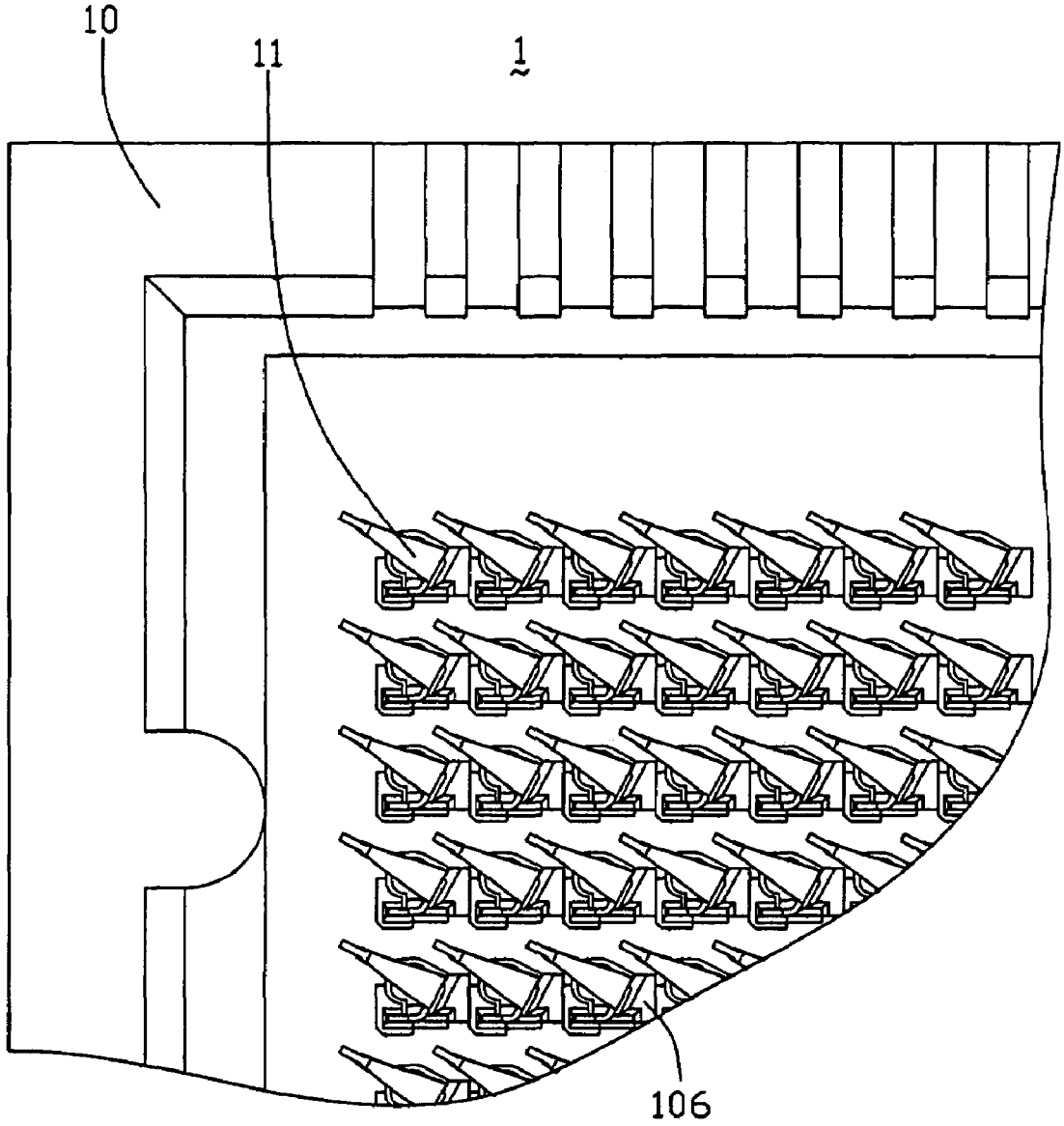
FIG. 5 is an enlarged view of part of FIG. 4, but showing a plurality of conductive terminals.

Referring to FIGS. 5-7, when a force is exerted down on the LGA chip 2 to make the pads 20 of the LGA chip 2 engage with the contacting portions 111 of the corresponding terminals 11, the force is borne by and distributed among the raised portions 102 and the protrusions 106 of the walls. This protects the LGA chip 2 from distortion or damage should the force be unduly great. This helps ensure that engagement between the connector 1 and the LGA chip 2 is accurate and reliable. In addition, because the protrusions 106 extend upwardly from the walls, the elbow 115 of the spring arm 114 of each terminal 11 is lower than the top surfaces of two adjacent protrusions 106. When the force is exerted on the LGA chip 2 to make the spring arm 114 deform downwardly, the adjacent protrusions 106 prevent the spring arm 114 from being laterally displaced. Therefore the contacting portion 111 can accurately and reliably connect with the corresponding pad 20 of the LGA chip 2.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for connecting an electronic package with a circuit substrate, the electrical connector comprising:

an insulative housing having a base with a space above an upper face of said base for receiving the electronic package therein, the base defining a plurality of passageways arranged in rows and columns; and a plurality of conductive terminals, each received in the corresponding passageway and defining a spring arm including a contacting portion extending away from a root portion of the spring arm for engagement with the electronic package; wherein said spring arm further defines at least one obliquely extending section, which is oblique to said rows and columns, so as to have the contacting portion located outside of the corresponding passageway from a top view, and essentially vertically located above a position which is offset from the corresponding row where the corresponding passageway is located, rather than another position which is aligned, with said corresponding row.

2. The electrical connector as claimed in claim 1, wherein said position which is offset from the corresponding row where the corresponding passageway is locate is essentially located between said corresponding row and an adjacent row which said obliquely extending section directs to.

3. The electrical connector as claimed in claim 1, wherein each of said terminals includes a retaining portion which extends in a direction either along the corresponding row or column where the corresponding passageway is located, so that said retaining portion is oblique to said obliquely extending section from a top view.

4. The electrical connector as claimed in claim 1, wherein said position which is offset from the corresponding row where the corresponding passageway is located is essentially in a diagonal direction relative to the corresponding passageway the terminal is disposed in.

5. The electrical connector as claimed in claim 4, wherein said position which is offset from the corresponding row where the corresponding passageway is located is closer to a neighboring passageway in said diagonal direction than to the corresponding passageway the terminal is disposed in.

* * * * *

US007371075C1

(12) EX PARTE REEXAMINATION CERTIFICATE (8689th)

United States Patent
Liao et al.

(10) Number: US 7,371,075 C1
(45) Certificate Issued: Nov. 22, 2011

(54) ELECTRICAL CONNECTOR WITH DUAL-FUNCTION HOUSING PROTRUSIONS

(75) Inventors: Fang-Jwu Liao, Tu-Chen (TW); Ming-Lun Szu, Tu-Chen (TW)

(73) Assignee: Hon Hai Precision Ind. Co., Ltd., Tu-Chen, Taipei Hsien (TW)

Reexamination Request:
No. 90/009,873, Feb. 1, 2011

Reexamination Certificate for:

| | |
|---|---|
| Patent No.: | **7,371,075** |
| Issued: | **May 13, 2008** |
| Appl. No.: | **10/894,735** |
| Filed: | **Jul. 19, 2004** |

(51) Int. Cl.

| | |
|---|---|
| ***H01R 12/00*** | (2006.01) |
| ***H01R 12/16*** | (2006.01) |
| ***H01R 13/24*** | (2006.01) |

(52) U.S. Cl. ..... 439/71

(58) Field of Classification Search ..... 439/71
See application file for complete search history.

(56) References Cited

To view the complete listing of prior art documents cited during the proceeding for Reexamination Control Number 90/009,873, please refer to the USPTO's public Patent Application Information Retrieval (PAIR) system under the Display References tab.

*Primary Examiner*—Erik Kielin

(57) ABSTRACT

An electrical connector (1) for connecting a land grid array (LGA) chip with a printed circuit board (PCB) includes a housing (10), and terminals (11) received in passageways (104) of the housing. The housing defines a base (100) and sidewalls (12, 14), the base and the sidewalls cooperatively defining a space therebetween for receiving the LGA chip. The base has a multiplicity of walls respectively between every two adjacent passageways along a length thereof, and four peripheral raised portions (102) extending upwardly and adjoining the sidewalls respectively. A multiplicity of protrusions (106) extends upwardly from the walls respectively. A height of the raised portions is the same as that of the protrusions. When a force is exerted down on the LGA chip to make the LGA chip engege with the terminals, a proportion of the force is borne by the protrusions and the raised portions.

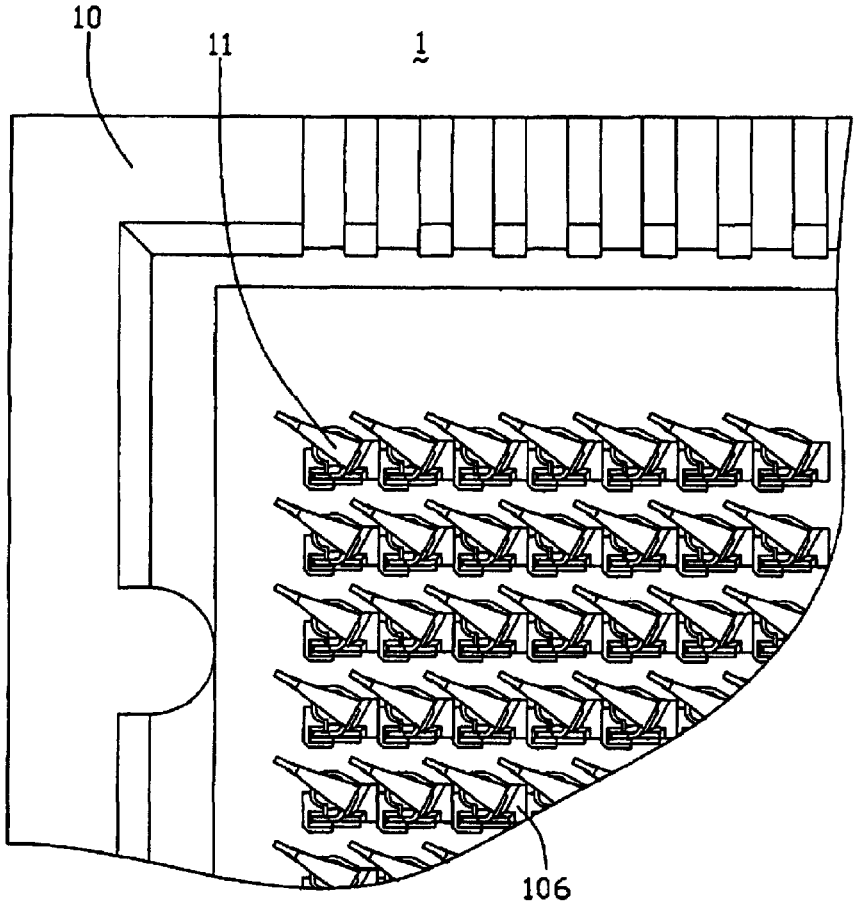

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 4 are cancelled.

Claims 2, 3 and 5 are determined to be patentable as amended.

2. The electrical connector as claimed in [claim 1,] *claim 5,* wherein said position which is offset from the corresponding row where the corresponding passageway is [locate] *located* is essentially located between said corresponding row and an adjacent row which said obliquely extending section directs to.

3. The electrical connector as claimed in [claim 1,] *claim 5,* wherein each of said terminals includes a retaining portion which extends in a direction either along the corresponding row or column where the corresponding passageway is located, so that said retaining portion is oblique to said obliquely extending section from a top view.

5. [The electrical connector as claimed in claim 4.] *An electrical connector for connecting an electronic package with a circuit substrate, the electrical connector comprising:*

*an insulative housing having a base with a space above an upper face of said base for receiving the electronic package therein, the base defining a plurality of passageways arranged in rows and columns; and*

*a plurality of conductive terminals, each received in the corresponding passageway and defining a spring arm including a contacting portion extending away from a root portion of the spring arm for engagement with the electronic package; wherein*

*said spring arm further defines at least one obliquely extending section, which is oblique to said rows and columns, so as to have the contacting portion located outside of the corresponding passageway from a top view, and essentially vertically located above a position which is offset from the corresponding row where the corresponding passageway is located, rather than another position which is aligned with said corresponding row;*

*wherein said position which is offset from the corresponding row where the corresponding passageway is located is essentially in a diagonal direction relative to the corresponding passageway the terminal is disposed in;* wherein said position which is offset from the corresponding row where the corresponding passageway is located is closer to a neighboring passageway in said diagonal direction than to the corresponding passageway the terminal is disposed in.

* * * * *

US007371075C2

(12) EX PARTE REEXAMINATION CERTIFICATE (10518th)

United States Patent
Liao et al.

(10) Number: US 7,371,075 C2
(45) Certificate Issued: Mar. 3, 2015

(54) ELECTRICAL CONNECTOR WITH DUAL-FUNCTION HOUSING PROTRUSIONS

(75) Inventors: Fang-Jwu Liao, Tu-Chen (TW); Ming-Lun Szu, Tu-Chen (TW)

(73) Assignee: Hon Hai Precision Ind. Co., Ltd., Tu-Chen, Taipei Hsien (TW)

Reexamination Request:
No. 90/012,004, Nov. 7, 2011

Reexamination Certificate for:

| | |
|---|---|
| Patent No.: | **7,371,075** |
| Issued: | **May 13, 2008** |
| Appl. No.: | **10/894,735** |
| Filed: | **Jul. 19, 2004** |

Reexamination Certificate C1 7,371,075 issued Nov. 22, 2011

(30) Foreign Application Priority Data

Jul. 18, 2003 (TW) ..... 92213181 U

(51) Int. Cl.
*H01R 12/00* (2006.01)
*H01R 13/24* (2006.01)

(52) U.S. Cl.
CPC ..... *H01R 13/2442* (2013.01); *H01R 12/00* (2013.01)
USPC ..... 439/71

(58) Field of Classification Search
None
See application file for complete search history.

(56) References Cited

To view the complete listing of prior art documents cited during the proceeding for Reexamination Control Number 90/012,004, please refer to the USPTO's public Patent Application Information Retrieval (PAIR) system under the Display References tab.

*Primary Examiner* — Albert J Gagliardi

(57) ABSTRACT

An electrical connector (1) for connecting a land grid array (LGA) chip with a printed circuit board (PCB) includes a housing (10), and terminals (11) received in passageways (104) of the housing. The housing defines a base (100) and sidewalls (12, 14), the base and the sidewalls cooperatively defining a space therebetween for receiving the LGA chip. The base has a multiplicity of walls respectively between every two adjacent passageways along a length thereof, and four peripheral raised portions (102) extending upwardly and adjoining the sidewalls respectively. A multiplicity of protrusions (106) extends upwardly from the walls respectively. A height of the raised portions is the same as that of the protrusions. When a force is exerted down on the LGA chip to make the LGA chip engege with the terminals, a proportion of the force is borne by the protrusions and the raised portions.

At the time of issuance and publication of this certificate, the patent remains subject to pending reissue application number 14/519,296 filed Oct. 21, 2014. The claim content of the patent may be subsequently revised if a reissue patent is issued from the reissue application.

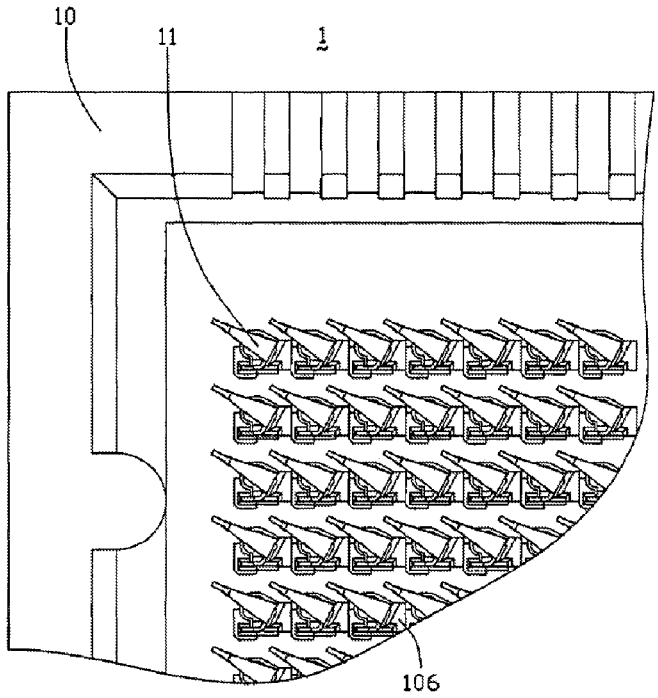

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1 and 4 were previously cancelled.

Claims 2, 3 and 5 are cancelled.

* * * * *